US005450170A

United States Patent [19]

Kimizuka et al.

[11] Patent Number: 5,450,170

[45] Date of Patent: Sep. 12, 1995

[54] IMAGE FORMING APPARATUS HAVING TRANSFER MEANS

[75] Inventors: Junichi Kimizuka, Yokohama; Toshiyuki Itoh, Sagamihara; Kaoru Sato, Yokohama; Akihisa Kusano; Kazuhiko Okazawa, both of Kawasaki; Toshihiko Inuyama, Fujisawa; Makoto Abe, Kashiwa, all of Japan

[73] Assignee: Canon Kabushiki Kaisha, Tokyo, Japan

[21] Appl. No.: 131,554

[22] Filed: Oct. 4, 1993

Related U.S. Application Data

[63] Continuation of Ser. No. 635,873, Dec. 28, 1990, abandoned.

[30] Foreign Application Priority Data

Dec. 29, 1989 [JP] Japan ..... 1-343033

[51] Int. Cl.[6] ..... G03G 21/00

[52] U.S. Cl. ..... 355/218; 347/248; 347/262; 355/244; 355/274; 355/317

[58] Field of Search ..... 355/218, 244, 206, 207, 355/272, 274, 275, 277, 308, 309, 317; 347/229, 248, 249, 262

[56] References Cited

U.S. PATENT DOCUMENTS

| | | | |
|---|---|---|---|
| 4,190,348 | 2/1980 | Friday | 355/274 |
| 4,847,657 | 7/1989 | Haneda et al. | 355/218 |
| 4,972,209 | 11/1990 | Tanigawa | 347/262 |
| 5,276,491 | 1/1994 | Fuma et al. | 355/274 X |

FOREIGN PATENT DOCUMENTS

| | | | |
|---|---|---|---|
| 57-8554 | 1/1982 | Japan | 355/218 |
| 57-78573 | 5/1982 | Japan | 355/218 |
| 0089824 | 4/1988 | Japan | 355/218 |
| 0236057 | 9/1988 | Japan | 355/218 |
| 2-039181 | 2/1990 | Japan . | |
| 2-115877 | 4/1990 | Japan . | |
| 2-136875 | 5/1990 | Japan . | |
| 2-156275 | 6/1990 | Japan . | |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An image forming apparatus includes a movable image bearing member; an image forming device for forming an image on the image bearing member; a transfer device for transferring an image from the image bearing member onto a recording material at a transfer position; a detector for detecting a recording material conveying passage from a recording material feeding station to the image transfer position; and a controller responsive to the detector to form blanks at a leading and trailing edges of the recording material by controlling image forming operation of the image forming device.

18 Claims, 7 Drawing Sheets

IMAGE FORMING APPARATUS HAVING TRANSFER MEANS

This application is a continuation of application Ser. No. 07/635,873 filed Dec. 28, 1990, now abandoned.

The present invention relates to an image forming apparatus such as an electrophotographic copying machine, an electrophotographic printer, an electrostatic recording machine or an electrostatic printer, having image transfer means. More particularly, the present invention relates to an image transfer type image forming apparatus wherein a transferable image is formed on an image bearing member such as an electrophotographic photosensitive member or an electrostatic recording dielectric member by image process means through an image forming process, and the image is sequentially transferred onto a recording material surface by a contact type transfer means wherein a recording material is press-contacted to the image bearing member.

Referring first to FIG. 10, there is shown an example of an image forming apparatus which is in the form of an image transfer type laser beam printer using an electrophotographic process. It comprises an image bearing member in the form of an electrophotographic photosensitive drum (photosensitive drum) which is rotatable in the direction indicated by an arrow (clockwise direction) at a predetermined peripheral speed. The photosensitive drum 1 is subjected to the following image forming process on its surface during the rotation.

a. A whole surface uniform exposure by a pre-exposure lamp 2, by which the electric charge remaining on the photosensitive drum through the previous image forming step is removed.
b. The drum 1 undergoes a uniform positive or negative charging to a predetermined potential by a primary charger 3 (corona discharger in this example), the charger 3 being supplied with voltage from a voltage source 4.
c. The drum 1 undergoes a scanning exposure with image information with a laser beam scanner. A laser diode receives time series electric picture element signals corresponding to an intended image from an unshown external machine (image reading apparatus, an electronic computer, wordprocessor or the like), and outputs a laser beam modulated in accordance with the picture element signal. The output beam raster-scans the photosensitive drum with a polygonal mirror 6 rotated at a constant speed by a motor 7. The charged surface of the photosensitive drum 1 is exposed by such a laser beam, by which an electrostatic latent image of the intended information is formed on the surface of the photosensitive drum 1.
d. The latent image on the drum 1 is developed by the developing device 8.
e. The developed image (toner image) is transferred from the drum 1 to the recording material 14 by image transfer means. An elastic transfer roller 9 of conductive material (transfer member) is press-contacted to the photosensitive drum 1 and rotates following the rotation of the photosensitive drum 1. The transfer roller is supplied with an image transfer bias from a voltage source 10. The recording material 10 is supplied from an unshown sheet supplying station, and is supplied to an image transfer position Po where the transfer drum 1 and the transfer roller 9 is press-contacted to each other, by registration rollers 12 in accordance with the timing of the image signal application by the laser beam scanner onto the photosensitive drum surface 1. More particularly, when the leading edge of the toner image formed on the photosensitive drum 1 reaches the image transfer position Po in accordance with the rotation of the photosensitive drum, the leading edge of the recording material 14 reaches the transfer position Po. The recording material 14 enters the transfer position Po where the photosensitive drum 1 and the transfer roller 9 are press-contacted to each other, and it is press-contacted to the surface of the photosensitive drum 1 by the transfer roller 9 and is electrically charged to a predetermined potential by a voltage source connected to the transfer roller 9 so as to receive the toner image from the photosensitive drum 1 surface.
f. Image fixing. The recording material 14 having passed through the transfer position Po is separated from the photosensitive drum 1 and is conveyed to an image fixing device where the toner image is fixed. Then, the recording material is discharged.
g. Cleaning of the surface of the photosensitive drum 1. After the recording material is separated from the photosensitive drum, the surface of the photosensitive drum is subjected to the operation of a cleaning device 11 by which the residual toner or the like is removed therefrom, and is prepared for the next image forming operation.

As described in the foregoing, usually, the recording material is conveyed so that the leading edge of the toner image on the photosensitive drum 1 and the leading edge of the recording material are aligned at the image transfer position. However, the recording material more or less deviates during the conveyance thereof to the transfer position or may be jammed. If this occurs, a part or the entirety of the toner image on the photosensitive drum 1 is directly conveyed to the cleaning device without being transferred. This overcharges the cleaning device with the possible result of insufficient cleaning or toner scattering.

On the other hand, the contact type transfer means requires a far smaller transfer bias voltage than the image transfer means using a corona discharger. In addition, the corona production such as ozone or nitride is very small. Furthermore, the transfer efficiency is high. Because of these advantages, it has been widely used recently in printers.

The transfer member 9 does not directly contact the toner image bearing surface of the image bearing member because of the presence of the recording material 11 between itself and the image bearing member 1 during the image transfer operation. However, when the recording material is not fed to the transfer position Po due to failure in the recording material 14 conveyance or when the length in the conveyance direction of the recording material 14 is not determined, the transfer member 9 directly contact the toner image bearing surface of the image bearing member 1, by which the toner image is directly transferred onto the surface of the transfer member 9, thus contaminating the transfer member 9. The toner contamination of the transfer member 9 results in the contamination of the backside of the recording material or degradation of the image quality of the second image in the case of duplex (both sided) image forming apparatus.

SUMMARY OF THE INVENTION

Accordingly, it is a principal object of the present invention to provide an image forming apparatus wherein toner scattering is effectively prevented.

It is another object of the present invention to provide an image forming apparatus wherein improper cleaning due to overcharge of the cleaning device is effectively prevented.

It is a further object of the present invention to provide an image forming apparatus wherein the contamination with toner of the transfer member contacting to the image bearing member is effectively prevented.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The embodiments shown in the present invention will be described in conjunction with the accompanying drawings.

Figure 1:
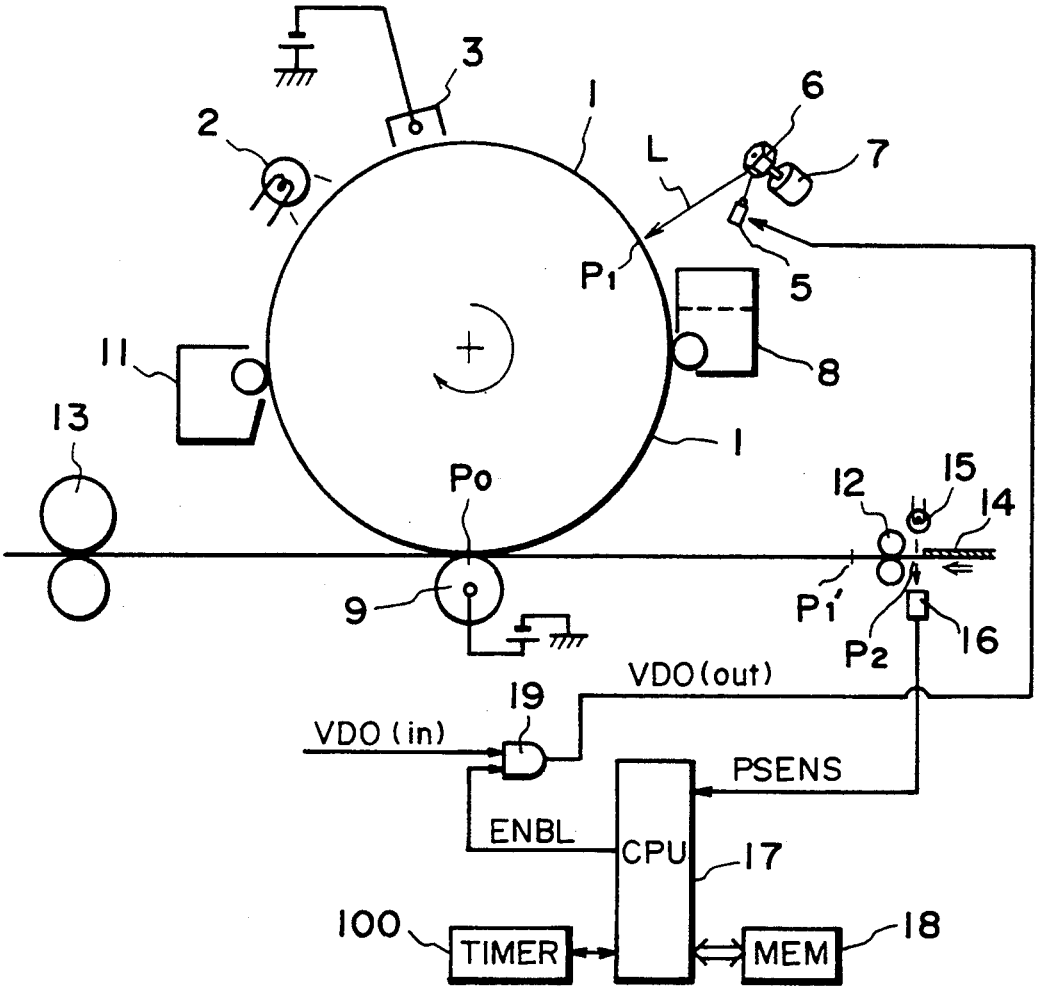
FIG. 1 shows an image forming apparatus according to a first embodiment of the present invention.
Figure 10:
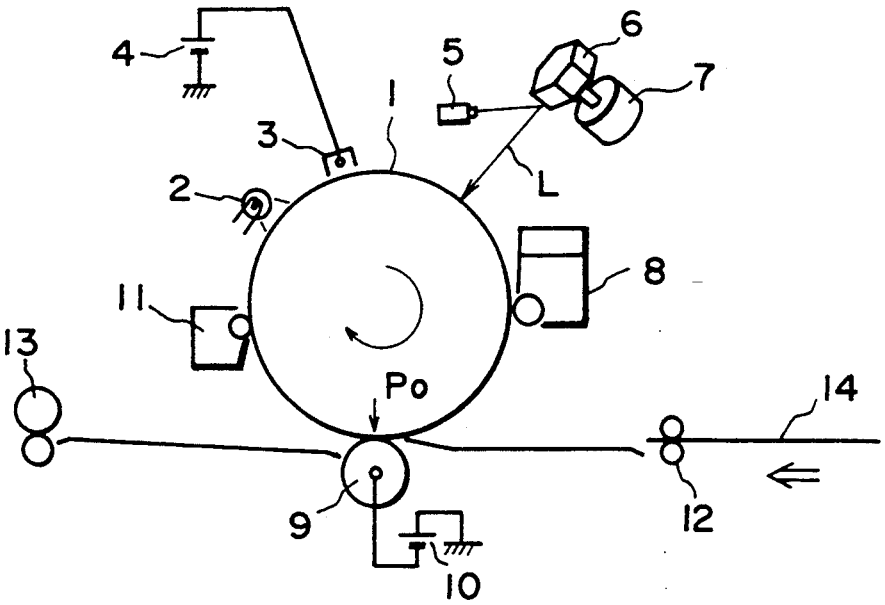
FIG. 10 shows an example of a conventional apparatus.

In FIG. 1, the present invention is incorporated in a laser beam printer of FIG. 10.

Referring first to FIG. 1, there is shown an example of an image forming apparatus which is in the form of an image transfer type laser beam printer using electrophotographic process to which the present invention is applied. It comprises an image bearing member in the form of an electrophotographic photosensitive drum (photosensitive drum) which is rotatable in the direction indicated by an arrow (clockwise direction) at a predetermined peripheral speed. The photosensitive drum 1 is subjected to the following image forming process on its surface during the rotation.

a. A whole surface uniform exposure by a pre-exposure lamp 2, by which the electric charge remaining on the photosensitive drum through the previous image forming step is removed.

b. The drum 1 undergoes a uniform positive or negative charging to a predetermined potential by a primary charger 3 (corona discharger in this example), the charger 3 being supplied with voltage from a voltage source 4. In this embodiment, the photosensitive drum surface is charged to a negative polarity, as will be understood from FIG. 1.

c. The drum 1 undergoes a scanning exposure with image information with a laser beam scanner. A laser diode receives time series electric picture element signals corresponding to an intended image from an unshown external machine (image reading apparatus, an electronic computer, wordprocessor or the like), and outputs a laser beam modulated in accordance with the picture element signal. The output beam raster-scans the photosensitive drum with a polygonal mirror 6 rotated at a constant speed by a motor 7. The charged surface of the photosensitive drum 1 is exposed by such a laser beam, by which an electrostatic latent image of the intended information is formed on the surface of the photosensitive drum 1.

d. The latent image or the drum 1 is developed with toner by the developing device 8. The development is a reverse development wherein the portion of the photosensitive drum exposed to the laser beam receives the toner.

e. The developed image (toner image) is transferred from the drum 1 to the recording material 14 by image transfer means. An elastic transfer roller 9 of conductive material (transfer member) is press-contacted to the photosensitive drum 1 and rotates following the rotation of the photosensitive drum 1. The transfer roller 9 comprises a core metal coated with EPDM sponge having a volume resistivity of $10^7$–$10^9$ ohm.cm. The transfer roller 9 are supplied with an image transfer bias of a polarity opposite from the charging polarity of the toner from a voltage source 10. The recording material 10 is supplied from an unshown sheet supplying station, and is supplied to an image transfer position Po where the transfer drum 1 and the transfer roller 9 is press-contacted to each other, by registration rollers 12 in accordance with the timing of the image signal application by the laser beam scanner onto the photosensitive drum surface 1. More particularly, when the leading edge of the toner image formed on the photosensitive drum 1 reaches the image transfer position Po in accordance with the rotation of the photosensitive drum, the leading edge of the recording material 14 substantially reaches the transfer position Po. The recording material 14 enters the transfer position Po where the photosensitive drum I and the transfer roller 9 are press-contacted to each other, and it is press-contacted to the surface of the photosensitive drum 1 by the transfer roller 9 and is electrically charged to a predetermined potential by a voltage source connected to the transfer roller 9 so as to receive the toner image from the photosensitive drum 1 surface.

f. Image fixing. The recording material 14 having passed through the transfer position Po is separated from the photosensitive drum 1 and is conveyed to an image fixing device where the toner image is fixed by a heater. Then, the recording material is discharged.

g. Cleaning of the surface of the photosensitive drum 1. After the recording material is separated from the photosensitive drum, the surface of the photosensitive drum is subjected to the operation of a cleaning device 11 by which the residual toner or the like is removed therefrom, and is prepared for the next image forming operation.

A reference P1 designates a laser beam scanning exposure position (exposure point), latent image forming position on the photosensitive drum 1. A reference P1 is a position (detection point) where the recording material on the recording material conveyance passage passes from the recording material feeding means to the image transfer position Po (transfer point). The detection is effected by the detecting means 15 and 16. In this example, the detecting means uses a photosensor comprising an illumination lamp 15 and a photosensor 16. A crossing point between the recording material conveyance path and the optical path of the photosensor 15, 16 is the point of detection P2. When the photosensor 16 receives the light from the illumination lamp 15, it is discriminated that the recording material is not present at the detecting point P2. If the photosensor 16 does not receive the light, it is discriminated that the recording material is at the detection point P2.

In this example, the detection point P2 is upstream of the registration roller 12 with respect to the conveyance direction of the recording material. The distance from the point of detection P2 to the transfer point Po (recording material conveyance direction P2−Po) is longer than the movement distance of the photosensitive drum (P1−Po) from the exposure point P1 to the transfer point Po. A point P'1 is a point on the recording material conveyance passage which point corresponds to the exposure point P1 on the photosensitive drum 1 ((P'1−Po)=(P1−Po)).

When the recording material 14 passes by the detection point P2, the photosensor 16 detects the recording material 14 and supplies a detection signal PSENS to the CPU 17.

The CPU 17 effects an image forming process in accordance with memory 18 stored, in accordance with a predetermined sequence program.

The CPU 17 controls the input to a laser diode 5 for the image signal VD6 transmitted from an unshown external circuit in accordance with a laser emission permission signal ENBL through a gate circuit 19.

A description will be provided as to the operation of this embodiment of the present invention.

Figure 2A:
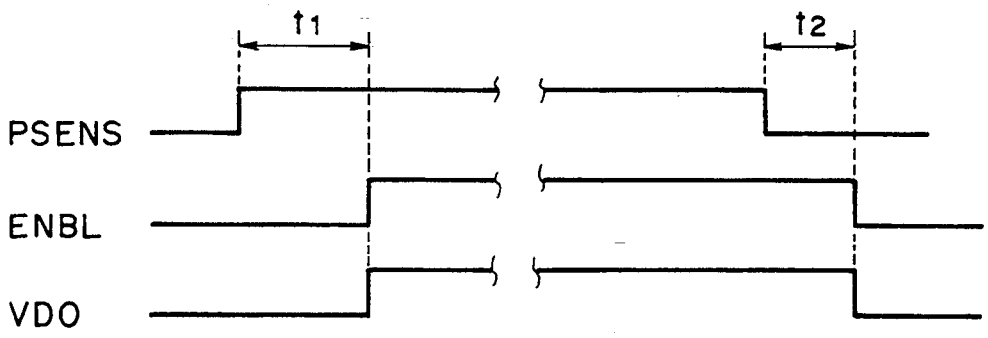
FIG. 2A is a time chart of various signals.
Figure 2B:
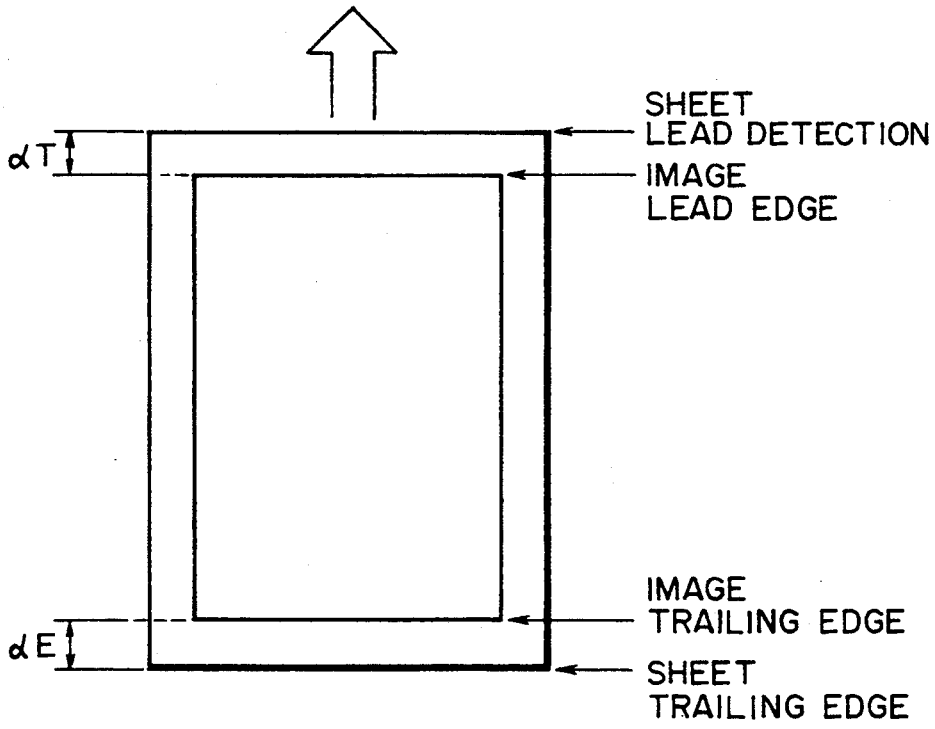
FIG. 2B illustrates the relation between the image and a dimension of the recording material.
Figure 3:
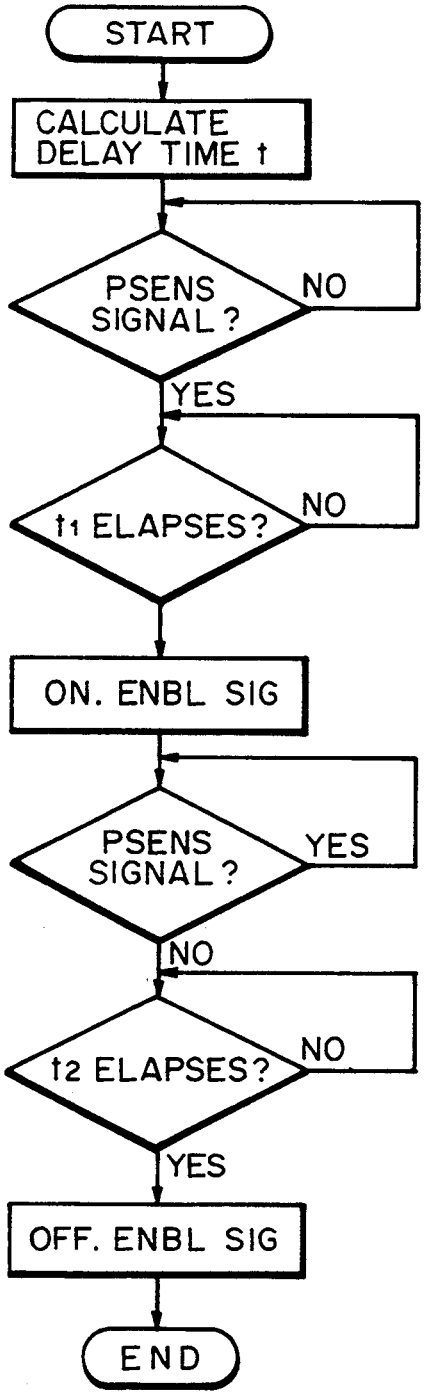
FIG. 3 is a flow chart of an operation of CPU.

FIG. 2A shows the timing of various signals, and FIG. 2B shows the relationship between the image and the dimension of the recording material. FIG. 3 is a flow chart illustrating operation of the CPU 17.

In FIG. 2B, $\alpha T$ and $\alpha E$ designate blanks (no-image portion), more particularly, $\alpha T$ is the distance from a leading edge of the recording material to the leading edge of the toner; and $\alpha E$ is the distance from the trailing edge of the toner image to the trailing edge of the recording material.

When the leading edge of the recording material 14 conveyed at a predetermined timing passes by a detection P2, the photosensor 16 detects the change from the recording material absent state to the recording material present state. At this time, the photosensor 16 supplies a detection signal PSENS to the CPU 17. The CPU 17 calculate the output timing of the laser emission permission signal ENBL on the basis of a recording material conveying speed and a distance (P2−P'1) between the detection point P2 and the exposure corresponding point P'1. For example, the output timing is delayed from the point of passage start of the recording material 14 at the detecting point P2 by a time period T1 ((P2−P'1)/v, where v is the conveyance speed of the recording material v which is equal to the peripheral speed of the photosensitive drum 1. The program is made such that when the timer 100 counts the time $t_1$, the laser emission permission signal ENBL is produced to start the latent image forming operation. The time period $t_1$ represents the coincidence between the leading edge of the image and the leading edge of the recording material at the transfer point Po.

Where the registration roller 12 is between the detecting point P2 and the transfer point Po as shown in FIG. 1, the rest period $t_s$ of the recording material 14 by the registration roller should be added, and in order to provide the blank of $\alpha T$ at the leading edge portion of the recording material 14, $t_1=(P2\ P'1+\alpha T)/v+t_s$.

Similarly, after termination of passage of the recording material 14 at the detecting point P2, the laser emission permitting signal ENBL is stopped with the delay of time period $t_2$. In other words, when the photosensor 16 detects the change from the presence of the recording material to the absence of the recording material at the detecting point P2, that is, when the timer 100 counts the time period $t_2$ from the detection of the trailing edge of the recording material, the laser emission permitting signal ENBL is stopped to prohibit the latent image formation. In consideration of the formation of the blank $\alpha E$ at the trailing edge of the recording material, the time period $t_2$ is $$(P2-P'1-\alpha E)/v$$

That is, in order to form the blanks at the leading and trailing edge of the recording material 14, $t_1>t_2$.

Irrespective of the detection of the presence or absence of the recording material at the detecting point P2, the charger 3 operates to charge the photosensitive drum 1. Therefore, the region of the drum where the above-described exposure operation is not effected is charged to the same polarity as the toner, and therefore, the region does not receive the toner.

As long as the laser emission permission signal ENBL is produced, the image signal $VD\bar{o}$ (OUT) inputted to the laser diode 5 is produced through the gate circuit 15, and therefore, the length of the latent image formed on the photosensitive drum 1 measured along the surface of the photosensitive drum 1 is smaller than the length of the recording material 14 in the conveyance direction. Therefore, the toner image does not pass the transfer point Po except for the passage of the recording material 14 of the transfer point Po.

The distance between the detection point P2 and the exposure corresponding point P'1 (P2−P'1) is larger than zero, since then the above-described control is possible, and therefore, it is selected to satisfy the above requirement. By the provision of the leading blank $\alpha T$ and the trailing blank $\alpha E$, the transfer roller 9 is prevented from being contaminated even if the conveyance of the recording material 14 is more or less deviated. If the recording material is jammed before the detecting point, the toner image is not formed on the photosensitive drum 1, and therefore, the toner scattering and the overcharge of the cleaning device attributable to the failure of the toner image transfer from the photosensitive drum 1, can be prevented.

Figure 11:
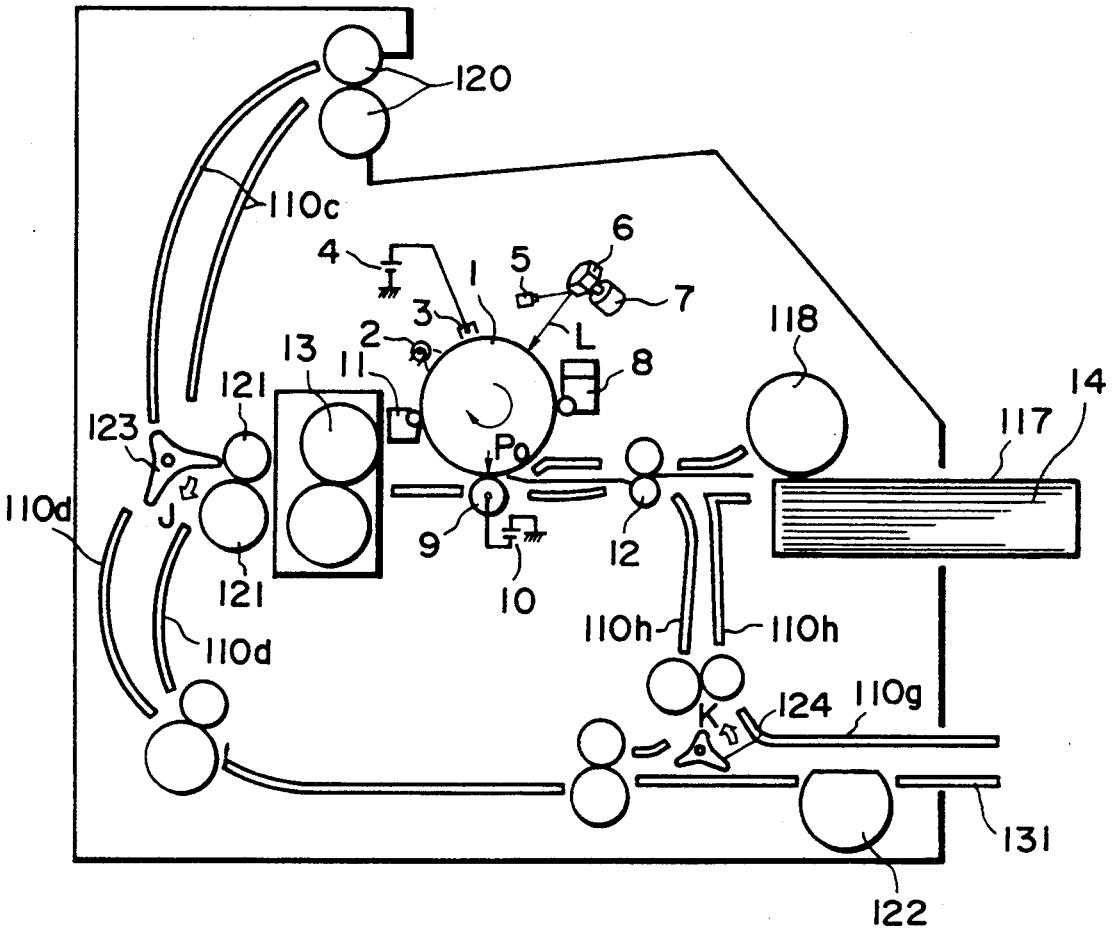
FIG. 11 shows a major part of an image forming apparatus according to a fourth embodiment of the present invention.

FIG. 11 shows a laser beam printer as an exemplary image forming apparatus capable of producing a duplex print having images at both sides. The operation for forming an image on one side of the recording material is the same as those described in conjunction with FIG. 1, and therefore, the detailed description is omitted for simplicity. A description will be provided as to the operation after the image is formed on one side of the recording material 14 and is fixed thereon, in the duplex mode. Reference numerals 117 and 118 denote a cassette accommodating the recording material 14 and a feeding roller for feeding to the registration roller 12 the recording material 14 from the cassette 117, respectively.

The recording material 14 having the image fixed on one side by passing through the fixing device 13 is conveyed to a conveying guide 110d by a flapper 123 taking the position shown in FIG. 11, after passing through the nip between the discharging rollers 121. The recording material 14 is directed by a flapper 124 to a guide 110*g*, and is passed by the flapper 124. It is stopped on an accommodator 131. Thereafter, the recording material is conveyed in the opposite direction (leftward direction in FIG. 11) by the feeding rollers 122 and is deflected by the flapper 124 toward the conveying guide 110*h*. The recording material 14 is directed to the registration roller, again, and an image is formed on a side opposite from the side on which the toner image is already formed. The recording material 14 now having the images on both sides thereof passes through the discharging roller 121. Since the flapper 123 is now displaced to the direction J, the recording material 14 is directed to the guide 110*c*, and is discharged to the outside of the apparatus by the discharging rollers 120.

In the duplex image forming apparatus, similarly to the foregoing embodiment, the blanks are formed at the leading and trailing edges on both sides of the recording material. However, because the recording material passes through a heat fixing device 13 at an end of the first side copy, and therefore, the length of the recording material 14 is reduced. Therefore, the trailing edge as long as $\alpha E$ is not provided. This tends to extend the image beyond the recording material. Therefore, the delay period $t_2$ for the second side is made shorter than that for the first side, thus in the image forming apparatus of the duplex image formation type, the predetermined period $t_2$ for the second side is shorter than that for the first side, by which the image is confined within the recording material at the trailing edge. The exposure operation of the photosensitive drum 1 is stopped to prevent toner deposition, because reverse-development is used. If regular development is employed, the region is uniformly exposed to prevent toner deposition.

In this embodiment, the detecting point P2 for the recording material is selected to be before the exposure corresponding point P'1, by which image formation on the photosensitive drum is continued corresponding to the conveyance of the recording material by controlling the exposure means (latent image forming means). The same effects can be provided using other means if the detecting point P2 is before the transfer point Po.

Figure 4:
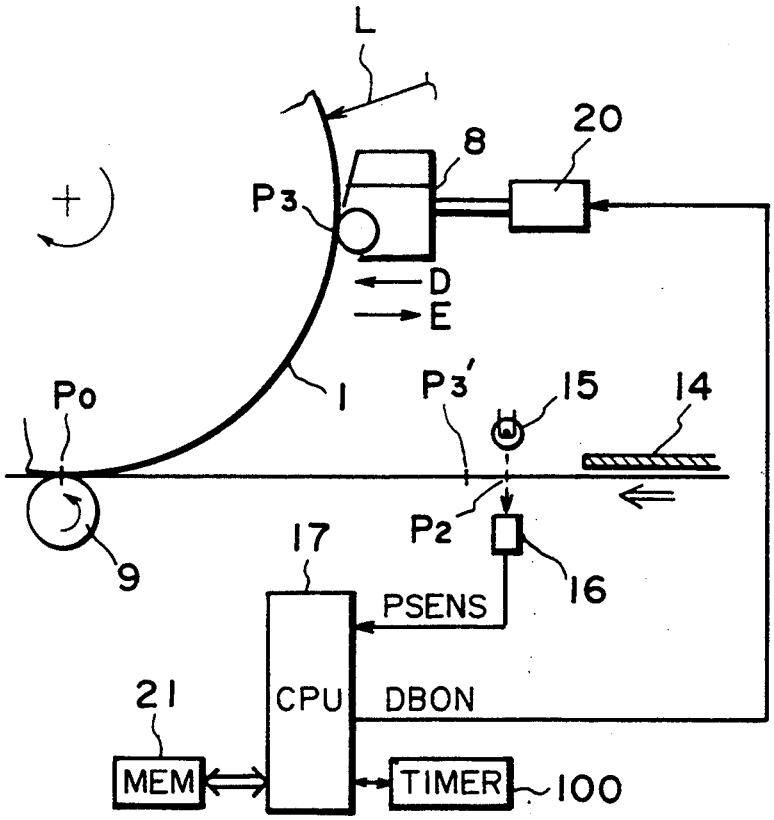
FIG. 4 shows a major part of an image forming apparatus according to a second embodiment of the present invention.

FIG. 4 shows an embodiment doing this. In the apparatus of FIG. 4, the fundamental structure and the operation is the same as the apparatus of FIG. 1, although they are not shown in this figure. The following description is limited to the points which are different from the apparatus of FIG. 1. Reference numeral 20 designates a clutch for selective engagement between the developing device 8 and the photosensitive drum 1. It is shifted in a direction D upon production of development permission signal DBON from the CPU 17 to enable the developing action. When the development permission signal DBON is not produced, it is shifted in the direction E, so that the photosensitive drum is not developed.

Reference P3 designates a developing position (developing point) by a developing device 8 on the photosensitive drum 1. A surface movement length (P3−Po) of the photosensitive drum 1 from the developing point P3 to the transfer point Po is larger than the recording material conveying passage (P2−Po) from the detecting point P2 to the transfer point Po.

Figure 5:
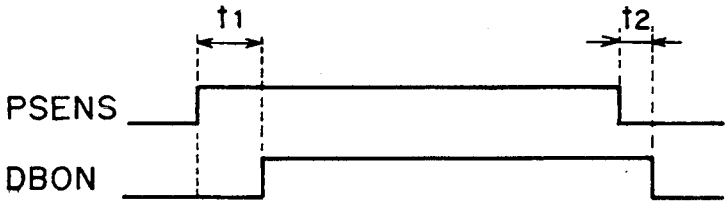
FIG. 5 is a time chart of various signals.

FIG. 5 shows timing chart of various signals, and referring to FIG. 5, the operation of the invention will be described. The CPU 17 effects its operation in accordance with a sequence program stored in the memory 21.

When the leading edge of the recording material reaches the detecting point P2, the CPU 17 produces the development permission signal DBON, as shown in FIG. 5, in synchronism with the detection signal PSENS from the photosensor.

In this case, the distance from the detecting point P2 to the transfer point Po is larger than the distance from the developing point P3 to the transfer point Po. After the timer 100 counts the time period $t_1$ from the production of the detection signal PSENS, the development permission signal DBON is produced to permit start of the developing operation. After the time 100 counts the time period $t_2$ after the stoppage of the detection signal PSEN by the passage of the trailing edge of the recording material at the detecting point P2, the development permission signal DBON is stopped to prohibit the developing operation.

Similarly, the development permission signal DBON is stopped to prohibit the developing operation.

Similarly to FIG. 2B case, the blanks $\alpha T$ and $\alpha E$ are formed at the leading and trailing edges of the recording material 14. Assuming that the conveying speed of the recording material 14 to the transfer position is v, the time period $t_1$ and $t_2$ are $$t_1=(P2-P3'+\alpha T)/v$$

$$t_2=(P2-P3'-\alpha E)/v$$

where (P3−Po)=P3'−Po and $t_1>t_2$.

By satisfying the requirement (P2−Po)>(P3−Po), the delay timing is calculated in a similar manner to the foregoing embodiment to control the output timing of the development permission signal DBON, whereby the toner image does not pass the transfer point Po during a period other than the transfer point Po passage period of the recording material 14. Therefore, contamination of the transfer roller 9, toner scattering in the apparatus and the overcharge of cleaning device can be prevented.

Figure 6:
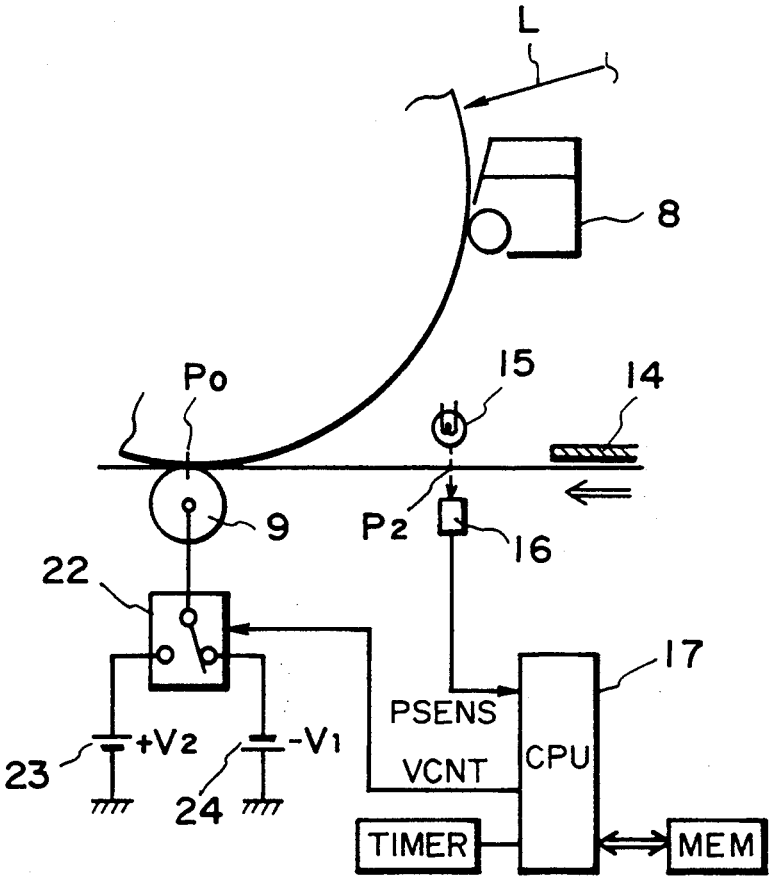
FIG. 6 shows a major part of an image forming apparatus according to a third embodiment of the present invention.

Referring to FIG. 6, a further embodiment of an image forming apparatus will be described. In this embodiment, in order to prevent the contamination of the transfer roller, the transfer roller 9 is directly provided with the toner image transfer preventing means. In FIG. 6, the fundamental structure and operation are the same as FIG. 1 apparatus. Therefore, the following description is limited to the points which are different from FIG. 1 apparatus. The detecting point P2 of the recording material 14 is before the transfer point Po. To the transfer roller 9, a voltage source 23 or 24 is connected through a switching circuit 22. The voltage source 23 produces a voltage +V2 having an opposite polarity from the charging polarity of the toner. When it is supplied to the transfer roller 9, the toner image is transferred to the recording material 14. The voltage source 24 produces a voltage −V1 having the polarity which is the same as the charging polarity of the toner. When it is connected to the transfer roller 9, the toner image is transferred to the photosensitive drum 1.

Figure 7:
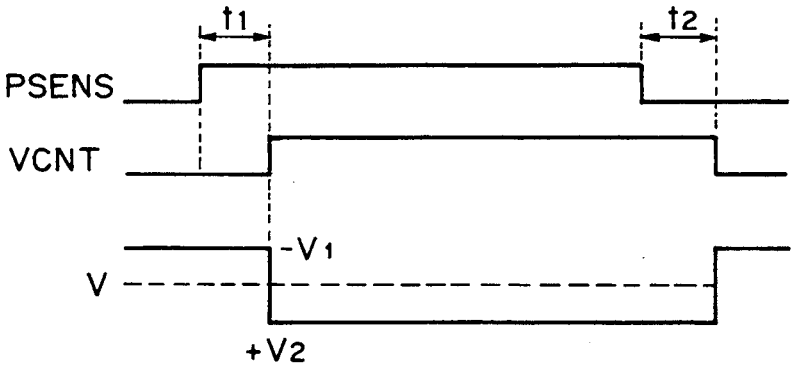
FIG. 7 is a time chart of various signals.

FIG. 7 is a timing chart for various signals. The operation of the invention according to this embodiment will be described.

The fundamental operation is the same as that shown in FIG. 3 flow chart. When the leading edge of the recording material 14 passes the detecting point P2, the photosensor 16 supplies a detection signal PSENS to the CPU 16.

The CPU 17 calculates output timing for the transfer control signal VCNT on the basis of the speed of the recording material conveyance and a distance between a detecting point P2 and the transfer point Po. That is, when the timer 100 counts $t_1$ after the leading edge of the recording material 14 is detected at the detecting point P2 (change from the absence of the recording material to the presence of the recording material), the transfer control signal VCNT is produced, and the transfer voltage becomes +V2. When the timer counts the time period $t_2$ after the trailing edge of the recording material is detected at the detecting point $t_2$ (change from the presence of the recording material to the absence of the recording material), the transfer control signal VCNT is stopped. In order to provide blanks at the leading and trailing edges of the recording material 14 as shown in FIG. 2B, $$t_1=(P2-Po+\alpha T)/v$$

$$t_2=(P2-Po-\alpha E)/v$$

$$t_1>t_2$$

If the recording material conveying speed v before the image transfer is contact, the delay period is fixed.

When the transfer control signal VCNT is supplied to the switching circuit 22 at the timing of the passage of the recording material 14 at the transfer point Po, the voltage V supplied to the transfer roller 9 becomes +V2, by which the transfer of the toner image to the recording material 14 is started. After completion of the passage of the recording material 14 at the transfer point Po, the voltage supplied to the transfer roller 9 becomes V1.

Therefore, the image transfer does not occur during a period other than the passage period of the recording material 14 at the transfer point, by which the contamination of the transfer roller can be prevented.

The prevention of the image forming operation on the recording material is effected solely by or in combination by exposure control of the image information exposure means to the image bearing member, stoppage of the developing operation, the reversal of the transfer bias to the transfer member and the like.

If the image forming operation is prevented by stopping the developing operation to the region of the photosensitive member where the image exposure is not effected, and in addition by applying to the transfer roller a voltage having a polarity opposite from the transferring polarity, the contamination of the transfer roller with the toner will be assuredly prevented. The switching of the potential of the transfer roller and the stoppage of the developing operation is effected on the basis of the detection of the presence or absence of the recording material at the detecting point P2.

In the foregoing embodiment, the recording material detecting sensor 15, 16 is disposed in the recording material conveyance passage.

Figure 8:
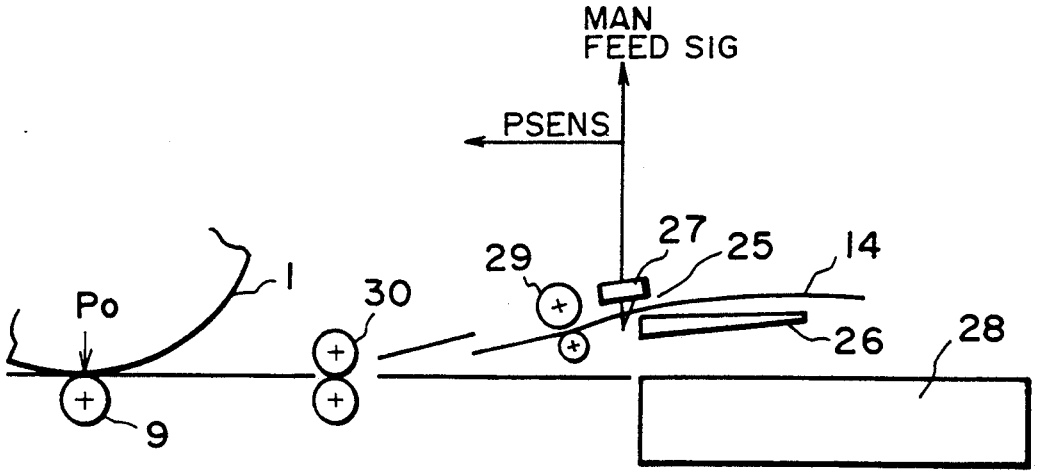
FIG. 8 shows a major part of a recording material feeding station usable with an image forming apparatus of the present invention.

FIG. 8 shows an electrophotographic printer having a manual sheet feed station 25. A manual feed detecting sensor 27 detects whether the recording material 14 is inserted into the manual feeding station 25. In accordance with the detection timing, the prohibition or prohibitions and release or releases of the image exposure, development, image transfer or the like may be controlled. This is particularly advantageous when the size of the recording material 14 is not determined.

In FIG. 8, reference numerals 28 and 26 designates a sheet feed cassette for supplying the sheets and a sheet feeding tray for permitting manual sheet feeding, respectively; and reference numerals 29 and 30 designate a pair of conveying rollers for conveying the sheets of paper.

Figure 9B:
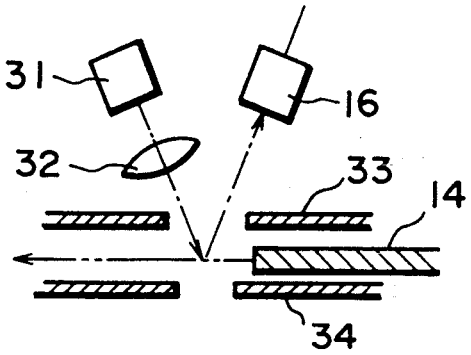
FIGS. 9A and 9B show examples of recording material detecting sensor.
Figure 9A:
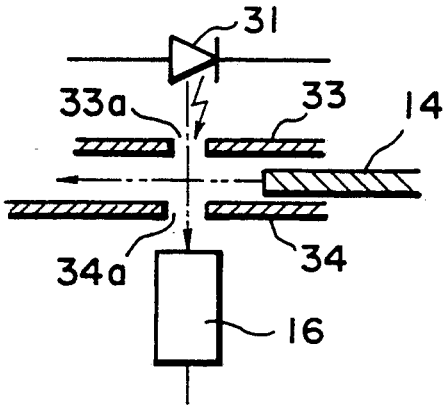

FIG. 9A shows another example of the recording material detecting sensor. A light emitting diode illuminates through a slit of an upper guide 33 for the recording material 14, and through a slit 34a of the lower guide 34, a light receiving element 16 receives the light to detect passage of the recording material 14. Using a thin slits 33a and 34a, the detection accuracy is improved.

FIG. 9B shows another example which is of a reflection type sensor. The light emitted from a light emitting diode 31 is condensed by a lens 32, and the light reflected by the recording material 14 is received by a light receiving element 16. By using a small light emitting part of the light emitting diode 31 or by using a laser diode, a fine spot can be produced to enhance the detection accuracy.

In the foregoing, a laser beam printer of an image transfer system using a photosensitive member of a rotatable drum type is shown. However, the present invention is not limited to this but is applicable to the image forming apparatus having a contact type transfer system using an electrostatic recording, magnetic recording or another image forming process. The image bearing member is not limited to the rotating drum, but a rotatable belt or traveling wave is usable. The contact type transfer member is not limited to the roller, but may be a rotatable belt or a traveling web. If a sufficient image transfer efficiency can be obtained by pressure-contact of the recording material 14 to the surface of the image bearing member, the application of the transfer bias to the transfer member 9 may be omitted (pressure transfer).

As described in the foregoing, the surface of the image bearing member is prohibited from toner image formation and therefore does not have the toner image except for the timing at which the recording material is actually passing the transfer position, and therefore, the scattering of the toner and the overcharging of the cleaning device can be prevented. In addition, when the transfer material is in direct contact with the surface of the image bearing member without the recording material at the transfer position, the surface of the image bearing member passing through the transfer position does not have the transferable image or the transfer of the transferable image is prevented if it is formed. Therefore, even if the transfer member is directly in contact with the image bearing surface, the contamination by the deposition of the transferable image to the transfer member can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming an image on said image bearing member;

image transfer means adapted to contact said image bearing member to transfer to a recording material an image from said image bearing member at a transfer position where said image transfer means contacts said image bearing member;

detecting means disposed in a recording material conveying passage from a recording material feeding station to the transfer position to detect presence or absence of the recording material;

control means responsive to said detecting means to provide blanks at leading and trailing edges of the recording material by controlling the image forming operation of said image forming means; and wherein said control means starts the image forming operation after a predetermined period $t_1$ elapses from detection by said detecting means of a change from the absence of the recording material to the presence of the recording material, and when absence of the recording material is detected by said detecting means, said control means prohibits the image forming operation simultaneously or after a time period $t_2$ elapses, where $t_2$ is less than $t_1$.

2. An apparatus according to claim 1, wherein said image forming means comprises a latent image forming means for forming a latent image on said image bearing member and developing means for developing the latent image.

3. An apparatus according to claim 2, wherein said control means controls the developing means to provide the blanks.

4. An apparatus according to claim 3, wherein said detecting means is so disposed that the distance from the detecting position by said detecting means in the conveyance passage to the transfer position is larger than the distance from a developing position to the transfer position measured along a surface of said image bearing member.

5. An apparatus according to claim 2, wherein said control means controls the latent image forming means to provide the blanks.

6. An apparatus according to claim 5, wherein said control means controls the developing means to provide the blanks.

7. An apparatus according to claim 5, wherein said image bearing member is a photosensitive member, and the latent image forming means includes exposure means for exposing the photosensitive member in accordance with image information after the photosensitive member is electrically charged, and wherein said control means controls the exposure means to provide the blanks.

8. An apparatus according to claim 7, wherein said exposure means uses a laser beam to expose the photosensitive member.

9. An apparatus according to claim 5, wherein said detecting means is so disposed that the distance from a detecting position of said detecting means in the conveyance passage to the transfer position is larger than the distance from a latent image forming position to the transfer position measured along a surface of said image bearing member.

10. An apparatus according to claim 1 or 6, wherein said control means controls operation of said transfer means to provide the blanks.

11. An apparatus according to claim 10, wherein said control means provides a potential of the transfer means having a polarity opposite to that during the transfer operation to provide blank.

12. An apparatus according to claim 1, wherein said transfer means is in the form of a roller.

13. An apparatus according to claim 1, wherein when an absence of the recording material which is being conveyed is detected by said detecting means, said control means prohibits the image forming operation, while permitting conveying operation for the recording material.

14. An image forming apparatus, comprising:

a movable image bearing member;

image forming means for forming an image on said image bearing member;

image transfer means adapted to contact said image bearing member to transfer to a recording material an image from said image bearing member at a transfer position where said image transfer means contacts said image bearing member;

detecting means disposed in a recording material conveying passage from a recording material feeding station to the transfer position to detect presence or absence of the recording material; and control means responsive to said detecting means to provide blanks at leading and trailing edges of the recording material by controlling a transfer operation of said image transfer means; and wherein said control means starts the transfer operation after a predetermined period, $t_1$, elapses after said detecting means detects a change from the absence of the recording material to the presence of the recording material, and when the absence of the recording material is detected by said detecting means, the transfer operation is prohibited simultaneously or after a predetermined time period, $t_2$, elapses, wherein $t_2$ is less than $t_1$.

15. An apparatus according to claim 14, wherein said detecting means is disposed upstream of the transfer position with respect to the recording material conveying direction.

16. An apparatus according to claim 14, wherein said control means provides a potential of said transfer means having a polarity opposite from that during transfer operation to provide the blanks.

17. An apparatus according to claim 14, wherein said transfer means is in the form of a roller.

18. An apparatus according to claim 14, wherein when an absence of the recording material which is being conveyed is detected by said detecting means, said control means prohibits the image transfer operation, while permitting conveying operation for the recording material.

* * * * *

UNITED STATES PATENT AND TRADEMARK OFFICE

CERTIFICATE OF CORRECTION

PATENT NO. : 5,450,170
DATED : September 12, 1995
INVENTOR(S) : JUNICHI KIMIZUKA, ET AL.

It is certified that error appears in the above-indentified patent and that said Letters Patent is hereby corrected as shown below:

Column [56] RC,
line FPD, "0089824 4/1988 Japan" and "0236057 9/1988 Japan" should read --63-089874 4/1988 Japan-- and --63-236057 9/1988 Japan--, respectively.

Column 1,
line 7, "abandoned." should read --abandoned. FIELD OF THE INVENTION AND RELATED ART--.

Column 2,
line 1, "is" should read --are--.

Column 3,
line 26, "of" should read --of the--. (2nd occurrence)

Column 4,
line 55, "I" should read --1--.

Column 5,
line 45, "VD6" should read --VDõ--.

Signed and Sealed this

Twenty-third Day of January, 1996

Attest:

Bruce Lehman

BRUCE LEHMAN

Attesting Officer

Commissioner of Patents and Trademarks